US006332802B2

(12) United States Patent
Hirokawa

(10) Patent No.: US 6,332,802 B2
(45) Date of Patent: Dec. 25, 2001

(54) MODULAR PLUG AND HARNESSED PLUG

(75) Inventor: Kenichi Hirokawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/813,000

(22) Filed: Mar. 21, 2001

(30) Foreign Application Priority Data

Mar. 23, 2000 (JP) ..... 12-081460

(51) Int. Cl.[7] ..... H01R 4/24
(52) U.S. Cl. ..... 439/418; 439/676; 439/941
(58) Field of Search ..... 439/418, 344, 439/676, 941

(56) References Cited

U.S. PATENT DOCUMENTS 5,571,035 * 11/1996 Ferrill ..... 439/941
5,899,770 * 5/1999 Ezawa ..... 439/941
6,080,007 * 6/2000 Dupuis et al. ..... 439/941
6,123,572 * 9/2000 Ishii et al. ..... 439/418
6,193,542 * 2/2001 Marowsky et al. ..... 439/418
6,213,809 * 4/2001 Viklund ..... 439/418

* cited by examiner

*Primary Examiner*—Tho D. Ta
(74) *Attorney, Agent, or Firm*—Kanesaka & Takeuchi

(57) ABSTRACT

A harnessed modular plug (21) includes at least first and second pairs of wires 22, 23); a guide plate (26) having at least two pairs of guide apertures (32) capable of arranging the wires of the first and second pairs in at least upper and lower rows; a housing (27) for receiving the guide plate; and at least two pairs of terminals (28) provided in the housing (27) at positions corresponding to the guide apertures (32). The wires (22, 22') of the first pair are arranged next to each other while the wires (23, 23') of the second pair are spaced across the first pair (22, 22') in the same row.

6 Claims, 9 Drawing Sheets

MODULAR PLUG AND HARNESSED PLUG

BACKGROUND OF THE INVENTION

1. Field of the Invention

The present invention relates to modular plugs for connecting a plurality of electric wires and harnessed modular plugs and, more particularly, to a modular plug for connecting a plurality of high-speed transmission wires and a harnessed modular plug.

2. Description of the Related Art

Modular jacks and plugs are used for telephone facilities or local area network (LAN). When a modular plug is plugged into a modular jack, the terminals thereof are brought into contact with each other for electrical connection. The arranging pitch of the terminals is specified to be 1.016 mm by the standards. As a result, the modular plug is provided with a device for arranging wires with such an arranging pitch.

Japanese patent application Kokai No. 10-506751 discloses a modular plug with an arranging device and a harnessed modular plug such as shown in FIGS. 12 and 13. A modular plug 1 comprises a guide plate 6 for arranging four pairs of wires 2-2', 3-3', 4-4', and 5-5', a housing 7 for receiving the guide plate 6, and a plurality of terminals 8. The wires 2-2', 3-3', 4-4', and 5-5' are twisted for each pair and covered by an insulating sheath to enhance the electric characteristics. Eight guide apertures 9 are provided in the guide plate 6 in a zigzag fashion in two rows. A plurality of terminal slots 10 extend downwardly from the upper face of the front portion of the housing 7.

To assemble the modular plug 1 and the harnessed modular plug, the front portions of each pair of the wires 2-2', 3-3', 4-4', or 5-5' are stripped of a length of the insulating sheath, untwisted, and inserted into the guide apertures 9 such that the wires are arranged in such an order as shown in FIG. 13; i.e., from left, the third pair 4-4', one of the second pair 3, the first pair 2-2', the other of the second pair 3', and the fourth pair 5-5'. The guide plate 6 is then fitted into the housing 7, and the terminals 8 are inserted into the terminal slots 10 to pierce into the respective wires 2-5' for electrical connection while the upper ends of the terminals 8 are exposed in the terminal slots 10.

However, the wires of each pair are arranged in different rows, especially, the wires 3-3' of the second pair are spaced apart in the different rows, making the wiring work difficult and requiring much labor in assembling the modular plug. The distance between the wires 3 and 3' is so large that the length of untwisted wires becomes large, making it difficult to minimize the crosstalk and/or attenuation.

SUMMARY OF THE INVENTION

Accordingly, it is an object of the invention to provide a modular plug and a harnessed modular plug capable of not only simplifying the wiring work but also enhancing the electric characteristics.

According to the invention there is provided a modular plug comprising a guide plate having guide apertures capable of arranging at least first and second pairs of wires in at least upper and lower rows; a housing for receiving the guide plate; at least two pairs of terminals provided at positions corresponding to the guide apertures, wherein the guide apertures are arranged such that wires of the first pair are provided next to each other and wires of the second pair are spaced across the first pair in the same row.

It is preferred that the guide apertures are made such that the wires of the first pair are arranged in the same row. The wires of a third pair and the wires of a fourth pair are provided adjacent to a wire and the other wire of the second pair, respectively. The guide apertures are made such that an outside wire of the third pair, an outside wire of the fourth pair, and the wires of the second pair are provided one of the two rows while an inside wire of the third pair, an inside wire of the fourth pair, and the wires of the first pair are provided in the other row.

According to another aspect of the invention there is provided a harnessed modular plug comprises at least first and second pairs of wire; a guide plate having at least two pairs of guide apertures capable of arranging the wires of the first and second pairs in at least upper and lower rows; a housing for receiving the guide plate; at least two pairs of terminal provided in the housing at positions corresponding to the guide apertures, wherein the wires of the first pair are arranged next to each other while the wires of the second pair are spaced across the first pair in the same row. The guide apertures are made such that the wires of the first pair are arranged in the same row. The wires of a third pair and wires of a fourth pair are arranged adjacent to a wire and the other of the second pair, respectively. The guide apertures are made such that an outside wire of the third pair, an outside wire of the fourth pair, and the wires of the second pair are arranged in one of the two rows while an inside wire of the third pair, an inside wire of the fourth pair, and the wires of the first pair are arranged in the other row.

To assemble the harnessed modular plug, the front portions of four pairs of wires are untwisted and inserted into the guide apertures. The guide plate with the arranged wires is then fitted into the housing. Then, terminals are pushed into the housing into the wires so that the terminals are electrically connected to the wires. The distance between the wires and the length of untwisted portions are minimized so that not only insertion of the wires into the guide plate is made easy but also the electrical characteristics are improved.

DESCRIPTION OF THE PREFERRED EMBODIMENTS

Figure 1:
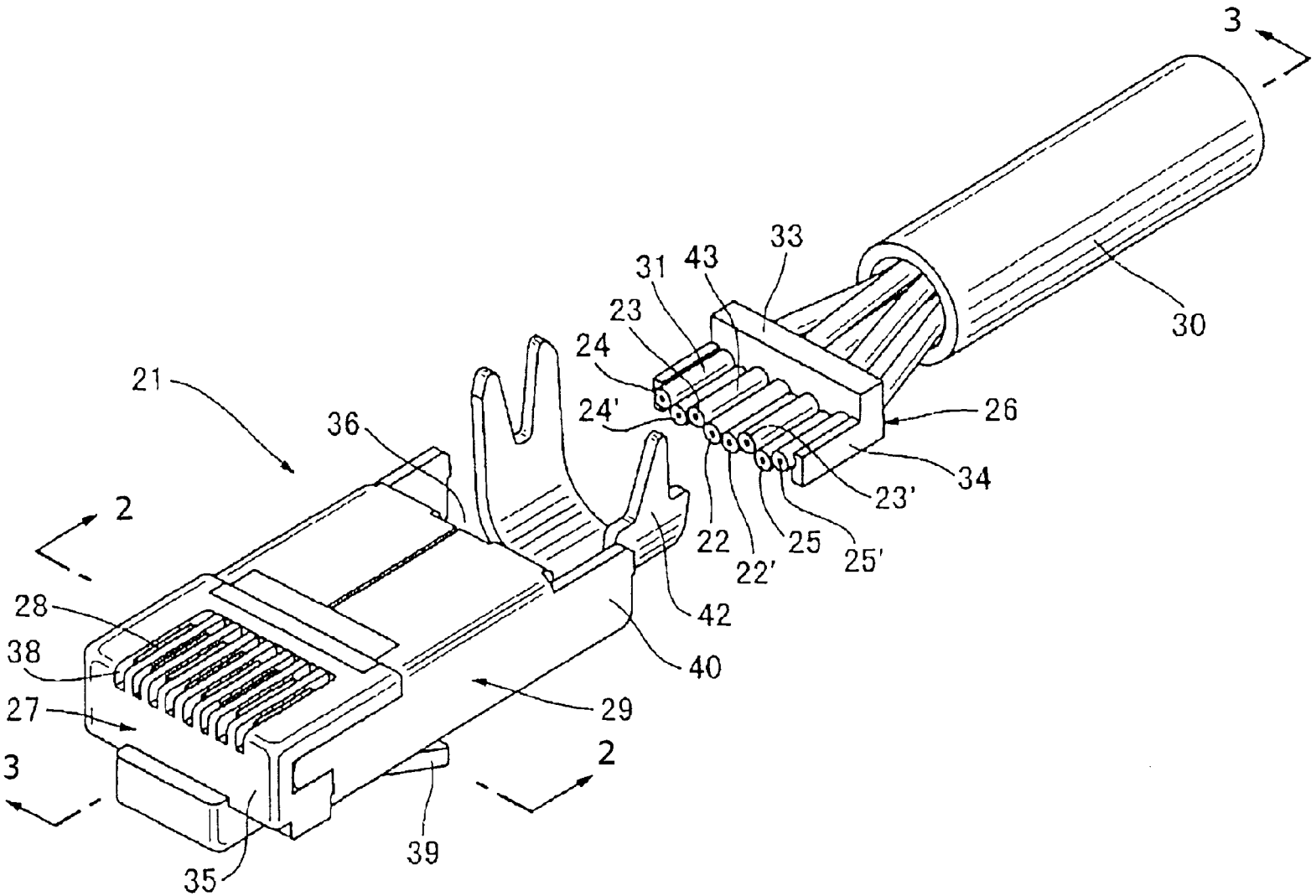
FIG. 1 is a perspective view of a modular plug according to an embodiment of the invention.

Embodiments of the invention will now be described with reference to the accompanying drawings.

In FIGS. 1–4, a modular plug 21 comprises a guide plate 26 for arranging four pairs of wires 22-22', 23-23', 24-24', and 25-25', and a housing 27 for receiving the guide plate 26. The wires 22-25' are high-speed transmission wires having an outside diameter of 1.1 mm and are twisted for each pair and covered by an insulating sheath 30. A front portions 31 of the wires 22-25' are stripped of the insulating sheath 30 and untwisted. Each front portion 31 is comprised of a single or stranded core wire and an insulating sheath 43 around the core wire. The guide plate 26 is made of a synthetic resin to provide an insertion section 33 having a plurality of guide apertures 32 and a pair of extended sections 34 extending forwardly from opposite sides of the insertion section 33. It is preferred that the inside faces of the extended sections 34 are made concave so as to match the outside form of the wire pair.

Figure 2:
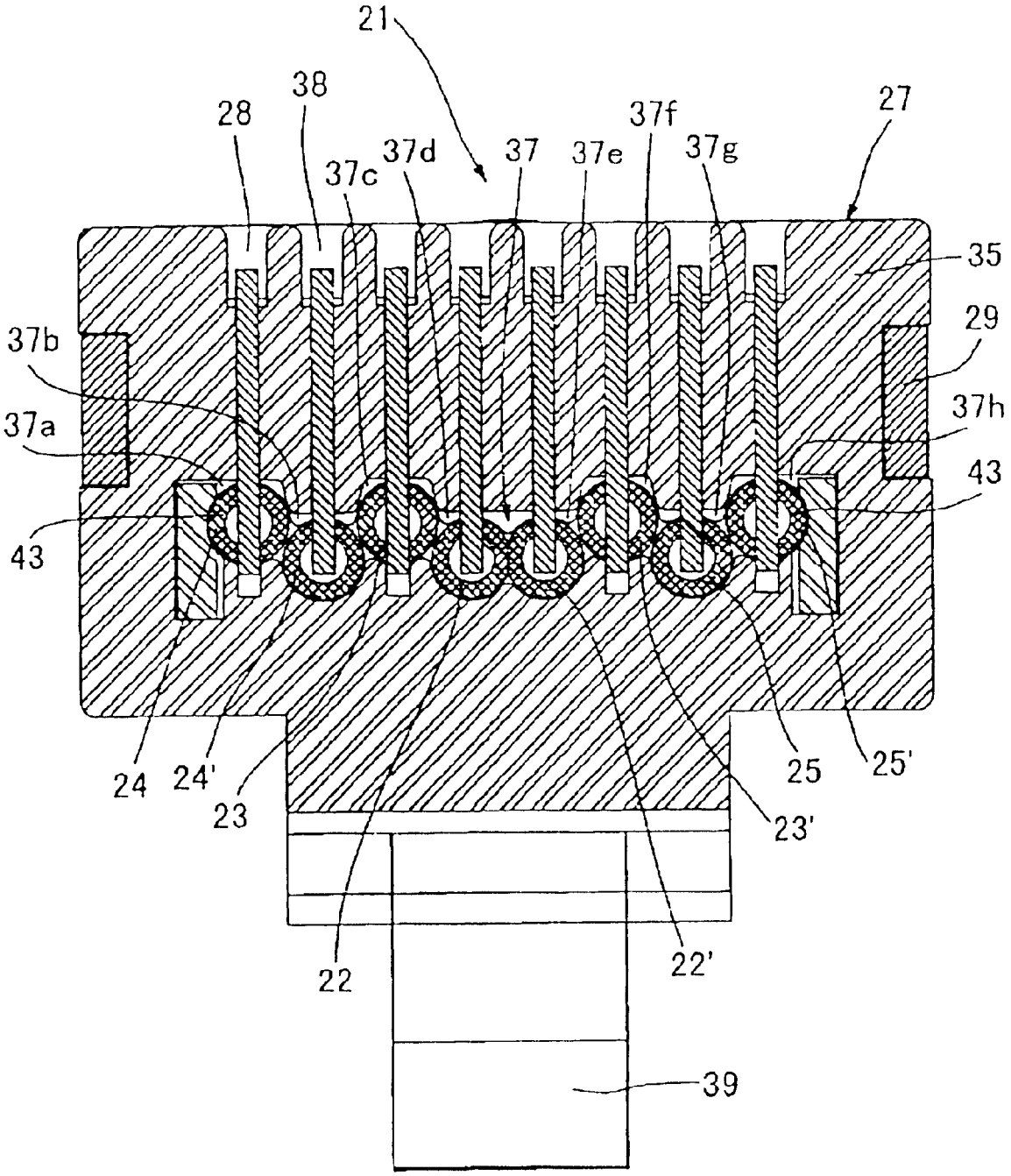
FIG. 2 is a sectional view taken along line 2—2 of FIG. 1.
Figure 3:
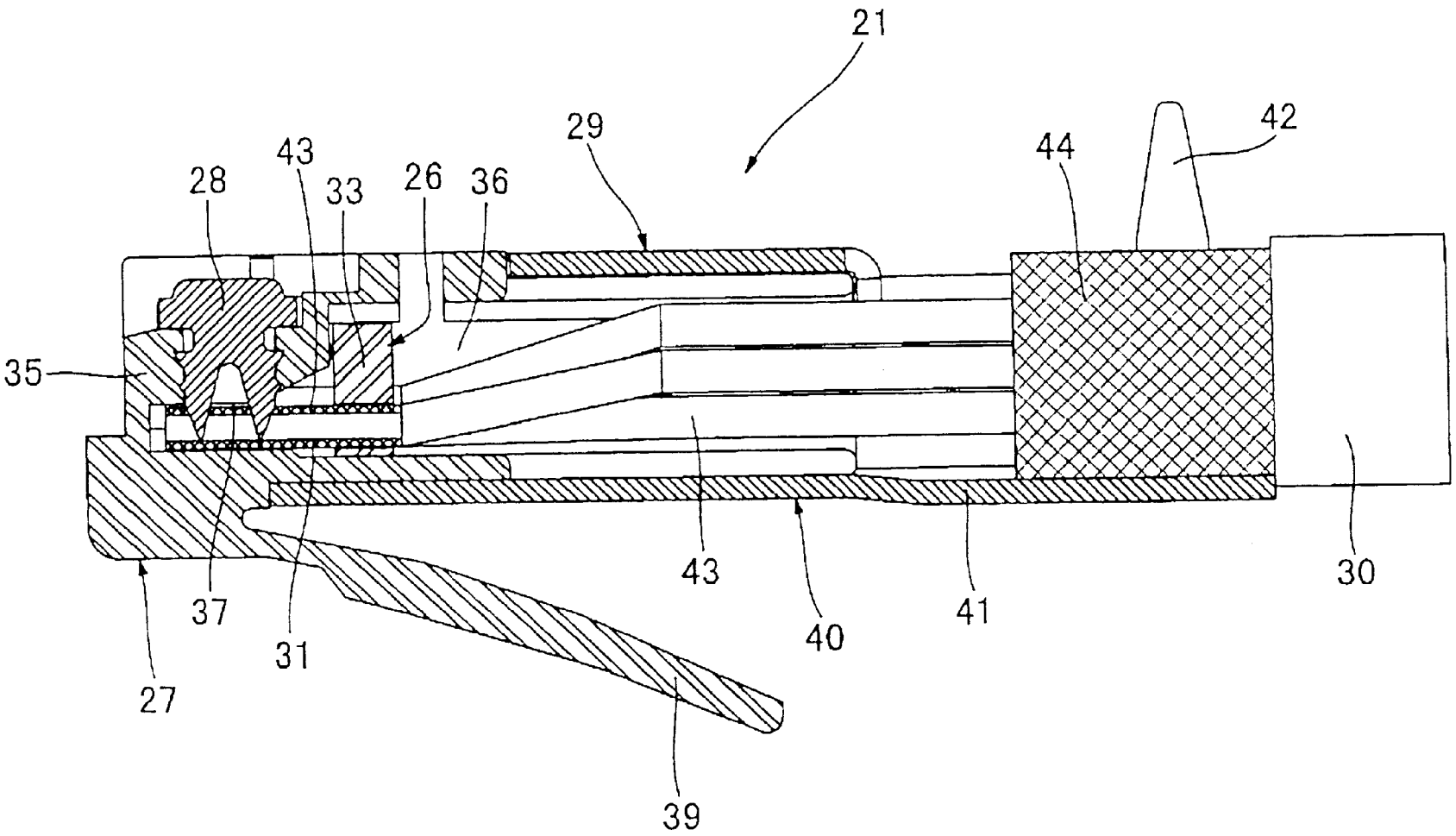
FIG. 3 is a sectional view taken along line 3—3 of FIG. 1.
Figure 4:
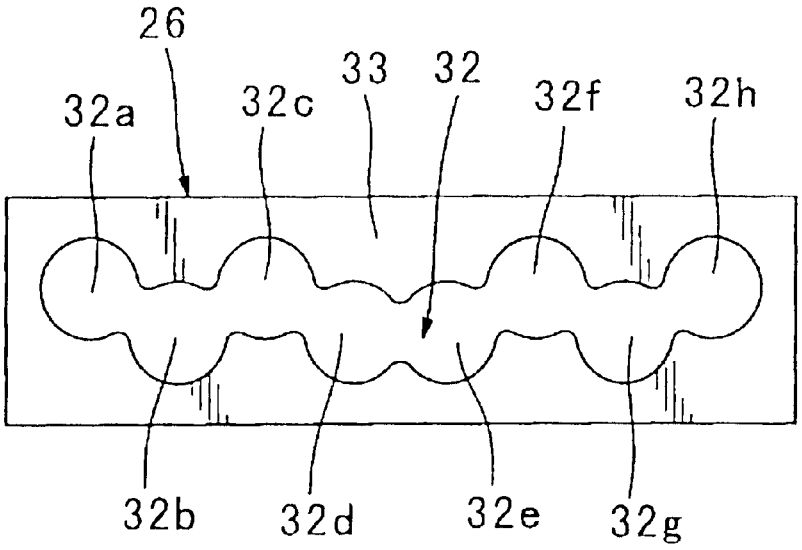
FIG. 4 is a front view of a guide plate for the modular plug.

As best shown in FIGS. 2 and 4, guide apertures 32*a*, 32*c*, 32*f*, and 32*h* are arranged in an upper row while guide apertures 32*b*, 32*d*, 32*e*, and 32*g* are arranged in the lower row. The wires 22 and 22' of the first pair are inserted in the two guide apertures 32*d* and 32*e* at the center while the wires 23 and 23' of second pair are inserted in the guide apertures 32*c* and 32*f* that are spaced across the first pair 22-22'. The wires 24 and 24' of the third pair are inserted in the guide apertures 32*a* and 32*b* adjacent to the wire 23 while the wires 25 and 25' of the fourth pair are inserted in the guide apertures 32*g* and 32*h* adjacent to the wire 22'.

The housing 27 is provided with a front portion 35, forming a cavity section 36 for receiving the guide plate 26 that holds the front portions 31 of respective wires. Eight engaging apertures 37 are provided in the front portion 35 such that respective engaging apertures 37*a–h* correspond to the guide apertures 32*a–h* of the guide plate 26. Eight terminal slots 38 extend downwardly from the upper face of the front portion 35 with a pitch of 1.016 mm and communicate with the respective engaging apertures 37*a–h*. A cantilevered engaging piece 39 extends rearwardly from the bottom of the front portion 35.

A removable terminal 28 with a bifurcated lower end is inserted in each of the terminal slots 38. It is preferred that all the terminals 28 are made identical in terms of the length and shape. A ground sheet 29 covers the housing 27 except for the terminal slots 38 and the engaging piece 39. The ground sheet 29 has a base section 40, a support section 41 extending rearwardly from the bottom of the base section 40, and a U-shaped wire grounding portion 42 that is crimped to a wire shield 44 of the cable 30.

How to assemble the modular plug 21 and the harnessed modular plug will be described.

The front portions 31 of four pairs of wires 22-22', 23-23', 24-24', and 25-25' are untwisted and inserted into the guide apertures 32. The wires 22 and 22' of the first pair are arranged in the same lower row, the wires 23 and 23' of the second pair are arranged in the same upper row. Since the wires 22 and 22' of the first pair are arranged next to each other, the distance between the wires 23 and 23' of the second pair be minimized, resulting in the reduced length of the untwisted front portions. Thus, it is easy to insert the wires into the guide plate 26 and the electrical characteristics are enhanced. The extended sections 34 hold the wire pairs between them so that the front portions of wire pairs are kept in the same condition as arranged by the guide plate 26.

Then, the guide plate 26 with the four pairs of wires 22-25' is fitted into the cavity section 36 of the housing 27 such that the front portions 31 of the wire pairs are inserted into the engaging apertures 37. Since the arranging condition of the wire pairs is kept by the guide apertures 32 and the extended sections 34, it is easy to fit the guide plate 26 into the housing 27.

Then, the terminals 28 are pushed into the terminal slots 38 such that the terminals 28 pierce the insulating sheaths 43 and make contact with the core wires. Consequently, the lower ends of the terminals 28 are electrically connected to the respective wires 22-25' while the upper ends are held in the terminal slots 38.

A variety of modifications may be made to the configuration of the guide apertures 32 as follows.

Figure 5:
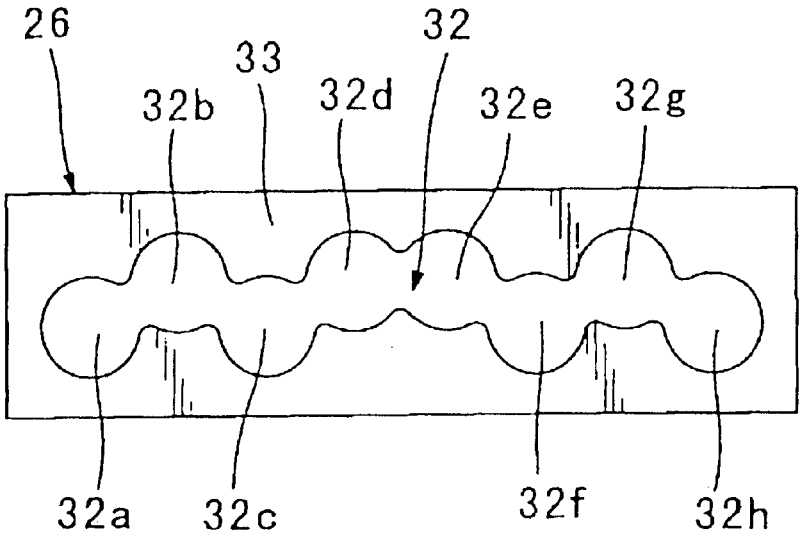
FIG. 5 is a front view of a guide plate according to the second embodiment of the invention.

In FIG. 5, the configuration of the guide apertures 32 in FIG. 4 is turned upside down.

Figure 6:
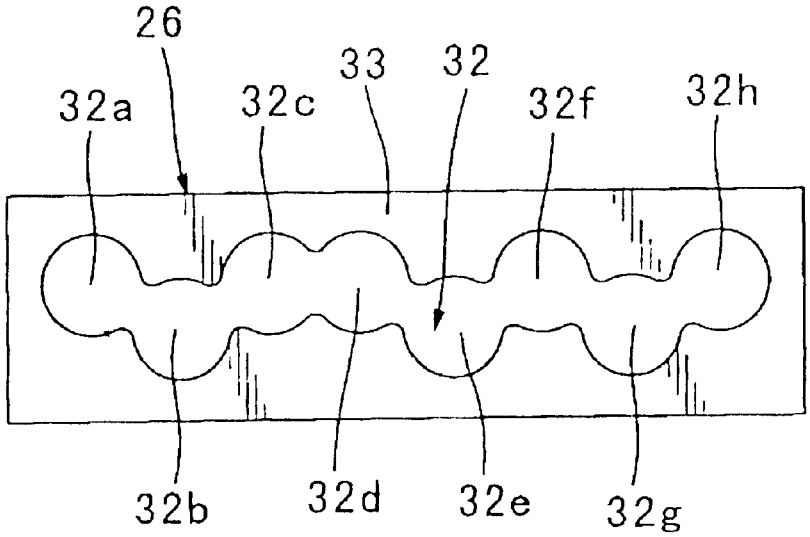
FIG. 6 is a front view of a guide plate according to the third embodiment of the invention.

In FIG. 6, the guide aperture 32*d* moved to the upper row from the lower row in FIG. 4.

Figure 7:
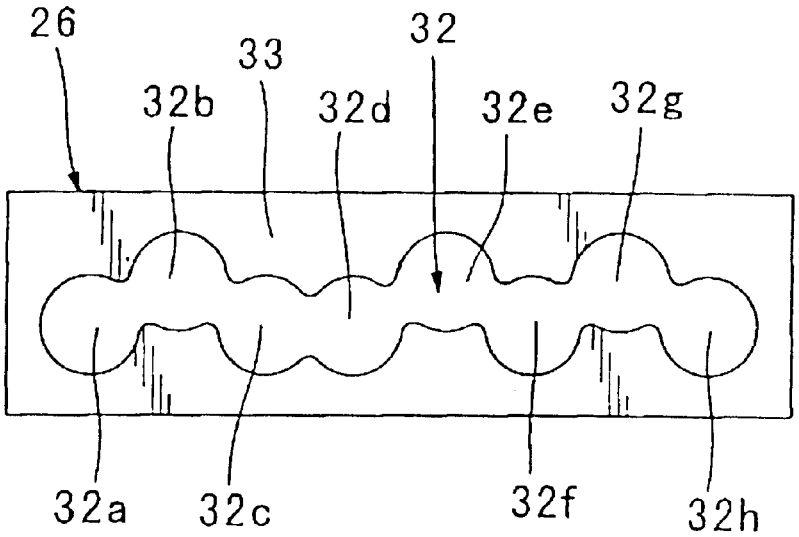
FIG. 7 is a front view of a guide plate according to the fourth embodiment of the invention.

In FIG. 7, the configuration of the guide apertures 32 in FIG. 6 is turned upside down.

Figure 8:
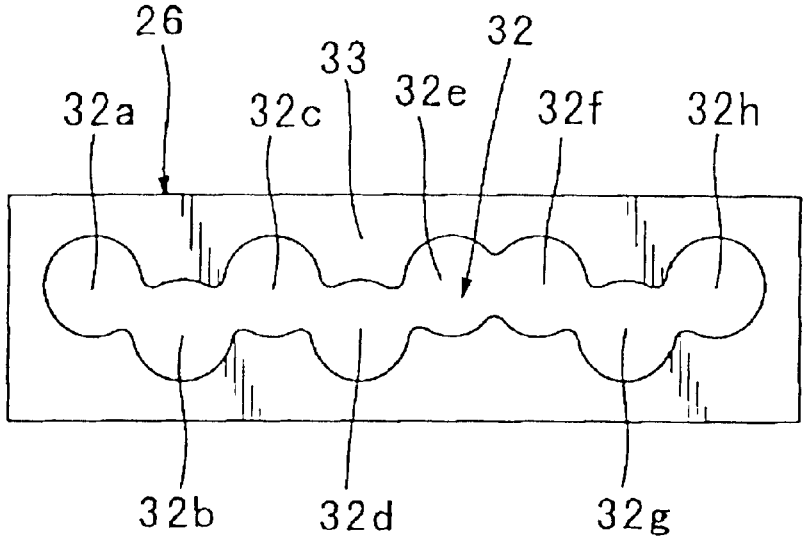
FIG. 8 is a front view of a guide plate according to the fifth embodiment of the invention.

In FIG. 8, the guide aperture 32*e* is moved to the upper row from the lower row in FIG. 4.

Figure 9:
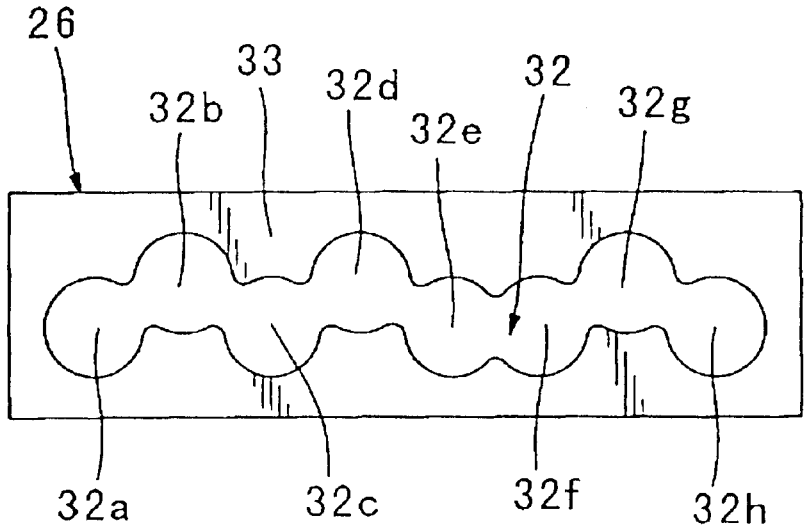
FIG. 9 is a front view of a guide plate according to the sixth embodiment of the invention.

In FIG. 9, the configuration of the guide apertures 32 in FIG. 8 is turned upside down.

Figure 10:
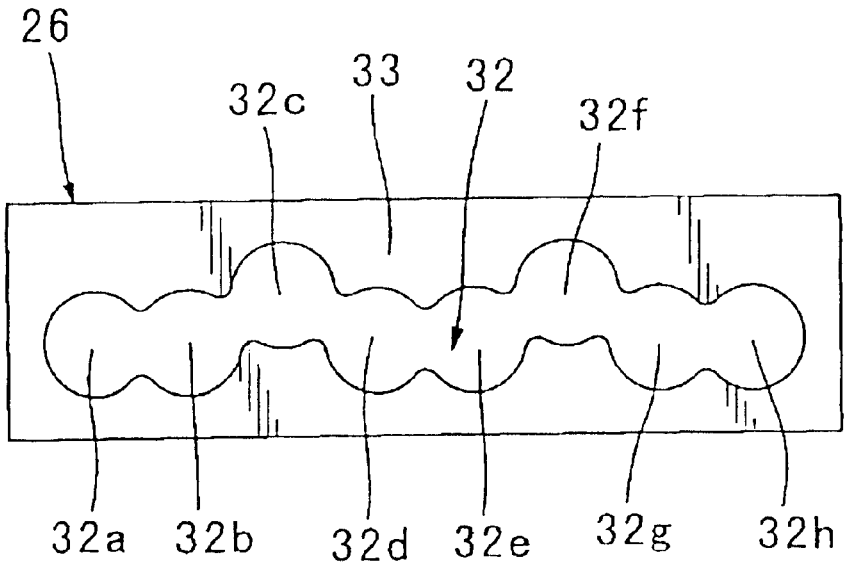
FIG. 10 is a front view of a guide plate according to the seventh embodiment of the invention.

In FIG. 10, the guide apertures 32*a* and 32*h* are moved to the lower row from the upper row in FIG. 4.

Figure 11:
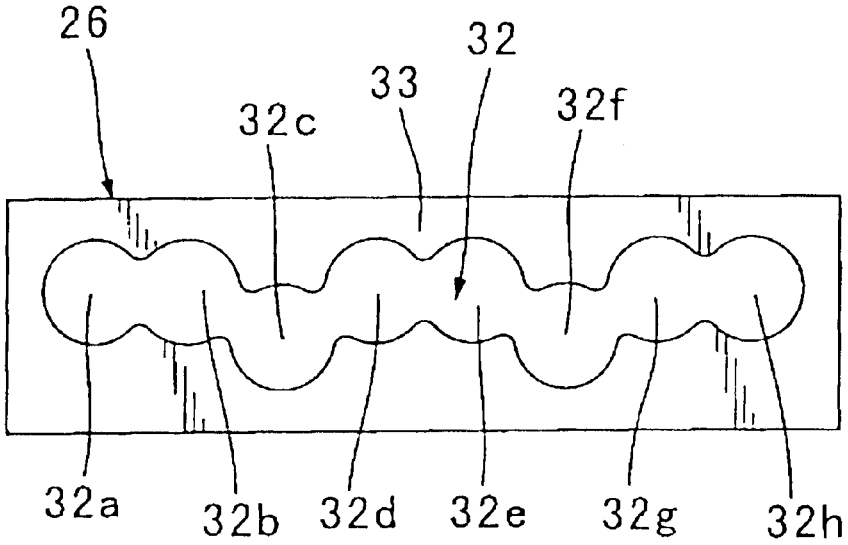
FIG. 11 is a front view of a guide plate according to the eighth embodiment of the invention.
Figure 12:
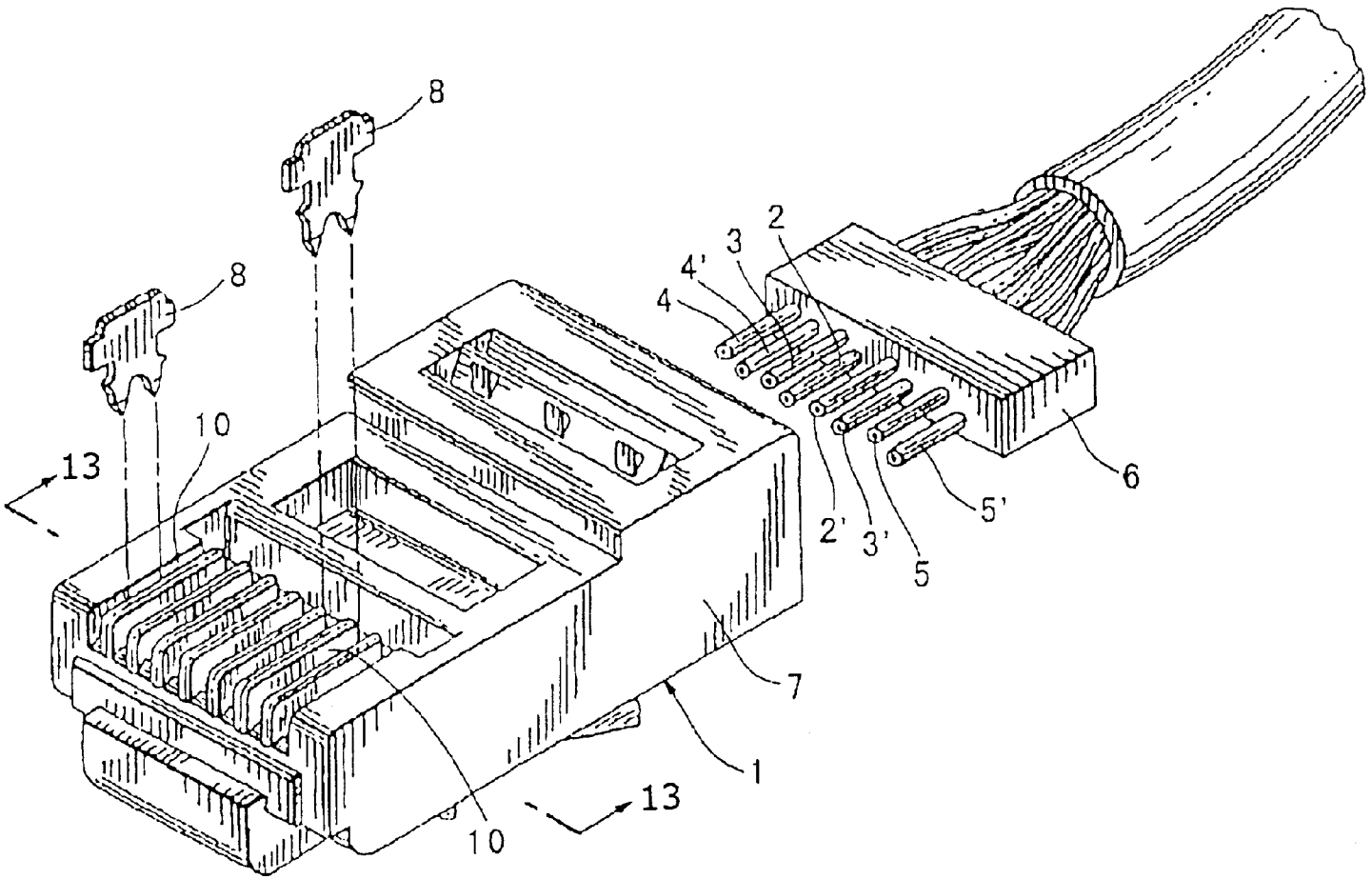
FIG. 12 PRIOR ART
FIG. 12 is a perspective view of a conventional modular plug.
Figure 13:
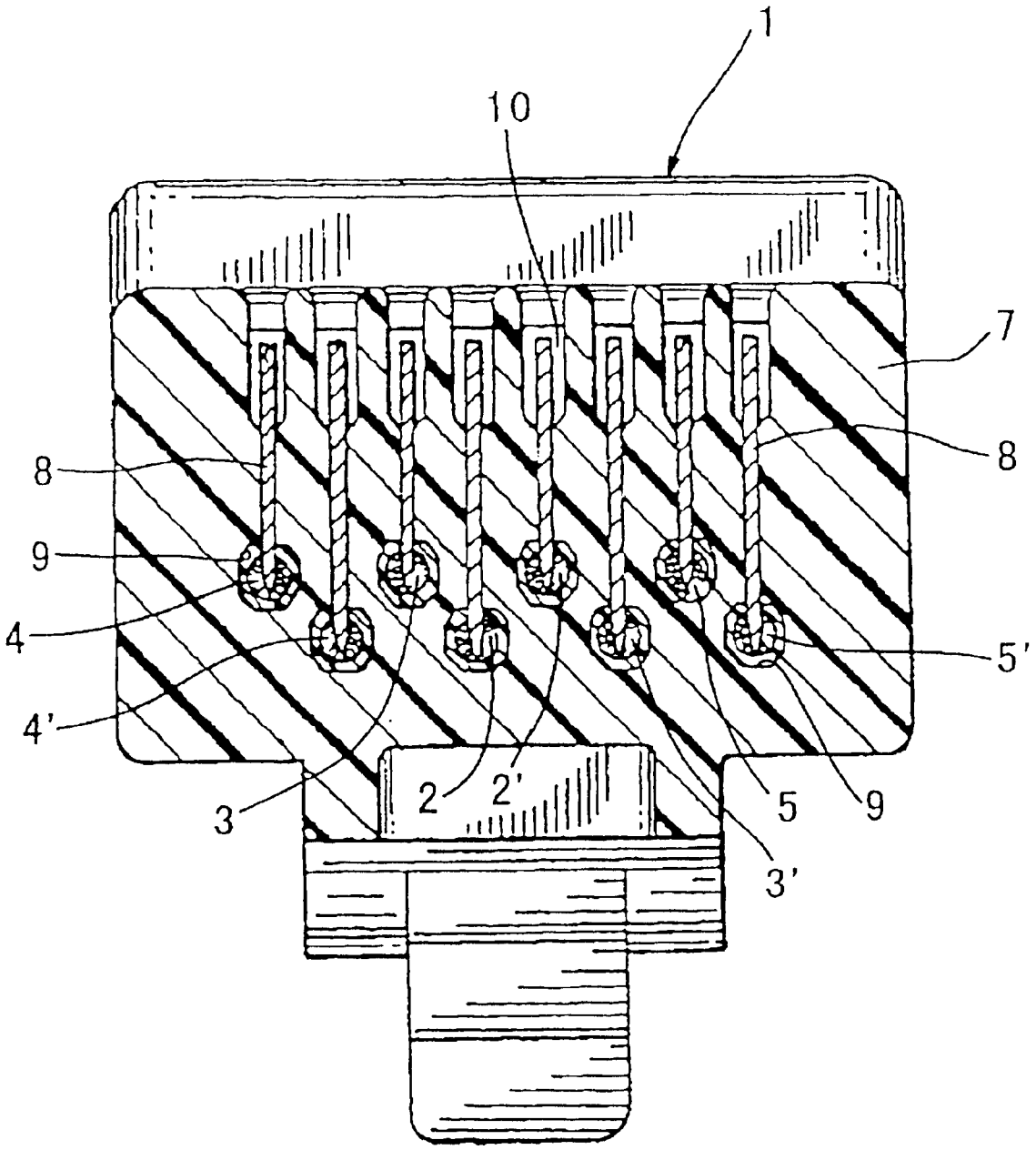
FIG. 13 PRIOR ART
FIG. 13 is a sectional view taken along line 13—13.

In FIG. 11, the configuration of FIG. 10 is turned upside down.

The four pairs of wires in the above embodiments may be replaced with two, three, five, or more pairs of wires. The guide apertures 32 in two rows in the above embodiments may be arranged in three or more rows. The outside diameter of the wires may range from 0.9 to 1.0 mm.

As has been described above, according to the invention, the wires of the first pair are arranged next to each other and the wires of the second pair are arranged in the same row so that it is easy to assemble the wires and the modular plug. The distance between the wires of the second pair and the length of the untwisted portions are made so small that the electrical characteristics, such as crosstalk and/or attenuation are improved.

What is claimed is:

1. A modular plug comprising:

a guide plate having guide apertures capable of arranging four pairs of wires in at least upper and lower rows;

a housing for receiving said guide plate;

four pairs of terminals provided at positions corresponding to said guide apertures;

said guide aperture being arranged such that wires of a first pair are provided next to each other, wires of a second pair are spaced across said first pair in the same row, wires of a third pair are provided outside a wire of said second pair, and wires of a fourth pair are provided outside the other wire of said second pair, wherein an outside wire of said third pair, an outside wire of said fourth pair, and said wires of said second pair are provided in one of said two rows while an inside wire of said third pair, an inside wire of said fourth pair, and said wires of said first pair are provided in the other row.

2. A harnessed modular plug comprising:

four pairs of wires;

a guide plate having guide apertures capable of arranging said four pairs of wires in at least upper and lower rows;

a housing for receiving said guide plate;

four pairs of terminals provided in said housing at positions corresponding to said guide apertures;

said guide apertures being arranged such that wires of a first pair are arranged next to each other, wires of a second pair are spaced across said first pair in the same row, wires of a third pair are arranged outside a wire of said second pair, and wires of a fourth pair are arranged outside the other wire of said second pair, wherein an outside wire of said third pair, an outside wire of said fourth pair, and said wires of said second pair are arranged in one of said two rows while an inside wire of said third pair, an inside wire of said fourth pair, and said wires of said first pair are arranged in the other row.

3. A modular plug comprising:

a guide plate having guide apertures capable of arranging four pairs of wires in at least upper and lower rows;

a housing for receiving said guide plate;

four pairs of terminals provided at positions corresponding to said guide apertures;

said guide aperture being arranged such that wires of a first pair are provided next to each other, wires of a second pair are spaced across said first pair in the same row, wires of a third pair are provided outside a wire of said second pair, and wires of a fourth pair are provided outside the other wire of said second pair, wherein an outside wire of said third pair, an outside wire of said fourth pair, a wire of said first pair, and wires of said second pair are provided in one of said two rows while an inside wire of said third pair, an inside wire of said fourth pair, and the other wire of said first pair are provided in the other row.

4. A modular plug comprising:

a guide plate having guide apertures capable of arranging four pairs of wires in at least upper and lower rows;

a housing for receiving said guide plate;

four pairs of terminals provided at positions corresponding to said guide apertures;

said guide aperture being arranged such that wires of a first pair are provided next to each other, wires of a second pair are spaced across said first pair in the same row, wires of a third pair are provided outside a wire of said second pair, and wires of a fourth pair are provided outside the other wire of said second pair, wherein said wires of said second pair are provided in one of said two rows while said wires of said third pair, said fourth pair, and said first pair are provided in the other row.

5. A harnessed modular plug comprising:

four pairs of wires;

a guide plate having guide apertures capable of arranging said four pairs of wires in at least upper and lower rows;

a housing for receiving said guide plate;

four pairs of terminals provided in said housing at positions corresponding to said guide apertures;

said guide apertures being arranged such that wires of a first pair are arranged next to each other, wires of a second pair are spaced across said first pair in the same row, wires of a third pair are arranged outside a wire of said second pair, and wires of a fourth pair are arranged outside the other wire of said second pair, wherein an outside wire of said third pair, an outside wire of said fourth pair, a wire of said first pair, and said wires of said second pair are arranged in one of said two rows while an inside wire of said third pair, an inside wire of said fourth pair, and said the other wire of said first pair are arranged in the other row.

6. A harnessed modular plug comprising:

four pairs of wires;

a guide plate having guide apertures capable of arranging said four pairs of wires in at least upper and lower rows;

a housing for receiving said guide plate;

four pairs of terminals provided in said housing at positions corresponding to said guide apertures;

said guide apertures being arranged such that wires of a first pair are arranged next to each other, wires of a second pair are spaced across said first pair in the same row, wires of a third pair are arranged outside a wire of said second pair, and wires of a fourth pair are arranged outside the other wire of said second pair, wherein wires of said second pair are arranged in one of said two rows while said wires of said third pair, said fourth pair, and said first pair are arranged in the other row.

* * * * *